US012534317B2

(12) United States Patent
Ikeda et al.

(10) Patent No.: US 12,534,317 B2
(45) Date of Patent: Jan. 27, 2026

(54) SHEET FEEDING APPARATUS

(71) Applicant: CANON KABUSHIKI KAISHA, Tokyo (JP)

(72) Inventors: Atsushi Ikeda, Kanagawa (JP); Yasuhito Tsubakimoto, Tokyo (JP); Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 17/867,079

(22) Filed: Jul. 18, 2022

(65) Prior Publication Data

US 2023/0015406 A1 Jan. 19, 2023

(30) Foreign Application Priority Data

Jul. 19, 2021 (JP) ..... 2021-118866

(51) Int. Cl.
*B65H 7/04* (2006.01)
*B65H 1/04* (2006.01)
*B65H 1/26* (2006.01)

(52) U.S. Cl.
CPC ..... *B65H 1/266* (2013.01); *B65H 1/04* (2013.01); *B65H 2405/31* (2013.01); *B65H 2553/40* (2013.01)

(58) Field of Classification Search
CPC ..... B65H 1/266; B65H 1/04; B65H 2405/31; B65H 2553/40; B65H 3/0684; B65H 7/04
See application file for complete search history.

(56) References Cited

U.S. PATENT DOCUMENTS 4,469,320 A * 9/1984 Wenthe, Jr. ..... B65H 7/02 271/94
5,897,112 A * 4/1999 Kwag ..... B65H 1/266 271/38
6,244,588 B1 * 6/2001 Tsubakimoto ..... G03G 15/6502 271/164
9,592,977 B2 3/2017 Ota et al.
(Continued)

FOREIGN PATENT DOCUMENTS

JP 5-24642 U 3/1993
JP 5-186093 * 7/1993
(Continued)

OTHER PUBLICATIONS

Machine translation of JP5-24642. (Year: 1993).*
(Continued)

*Primary Examiner* — Thomas A Morrison
(74) *Attorney, Agent, or Firm* — Venable LLP

(57) ABSTRACT

A sheet feeding apparatus includes a detection unit provided to be movable with respect to a sheet stacking portion and configured to detect a sheet by causing a contact portion to come into contact with an uppermost sheet stacked on a stacking surface. A bottom portion of the sheet stacking portion forms a part of a bottom portion of the sheet feeding apparatus, the sheet stacking portion is provided with a through-hole configured to be exposed in the case where no sheet is stacked on the stacking surface, the through-hole penetrates the stacking surface to a bottom surface of the sheet stacking portion, and the contact portion is positioned inside the through-hole in the case where no sheet is stacked on the stacking surface.

13 Claims, 6 Drawing Sheets

(56) References Cited

U.S. PATENT DOCUMENTS

| | | | | |
|---|---|---|---|---|
| 9,890,001 | B2 | 2/2018 | Taniguchi et al. | |
| 2002/0084574 | A1* | 7/2002 | Kim | B65H 1/266 271/118 |
| 2011/0133390 | A1* | 6/2011 | Ohfuchi | B65H 3/128 271/11 |
| 2018/0282084 | A1* | 10/2018 | Inoue | B65H 7/04 |

FOREIGN PATENT DOCUMENTS

| | | | |
|---|---|---|---|
| JP | 5-221553 | A | 8/1993 |
| JP | 2000-177855 | A | 6/2000 |
| JP | 2006-182463 | A | 7/2006 |
| JP | 2015-189563 | A | 11/2015 |

OTHER PUBLICATIONS

Machine translation of JP 5-186093. (Year: 1993).*
Office Action dated Apr. 18, 2023, in Japanese Application No. 2021-118866.

* cited by examiner

SHEET FEEDING APPARATUS

BACKGROUND OF THE INVENTION

Field of the Invention

The present invention relates to a sheet feeding apparatus having a detection unit configured to detect sheets stacked in a sheet stacking portion.

Description of the Related Art

As a sheet feeding apparatus of an image forming apparatus, there is known a configuration in which sheets stacked in a sheet stacking portion are separated one by one by a paper feeding roller and each sheet is fed to an image forming portion. When the paper feeding roller operates in a state in which no sheet is present in the sheet stacking portion, an excessive frictional force is generated between the paper feeding roller and the sheet stacking portion, and there is a possibility that the paper feeding roller and the sheet stacking portion may be damaged. By providing a detection unit configured to detect the presence or absence of the sheet in the sheet stacking portion, it is possible to prevent the damage caused by idle feeding.

In Japanese Patent Application Publication No. 2000-177855, a rack is provided at a position which is exposed in the case where no sheet is present in a sheet stacking portion (cassette), and an idler gear is coupled to a swing arm which supports a feeding roller. In the case where no sheet is present, the rack, the idler gear, and a gear provided on a rotation shaft of the feeding roller are engaged with each other. When no sheet is present, the driving force of a motor which drives the feeding roller is transmitted to the rack, and the sheet stacking portion is discharged to the outside of a main body.

In Japanese Patent Application Publication No. 2006-182463, a through hole is provided in a bottom portion of a detachable sheet stacking portion (cassette), and a lever is installed at a position below the sheet stacking portion in an image forming apparatus so as to pass through the through hole and project upward from the sheet stacking portion. This lever detects the presence or absence of a sheet in the sheet stacking portion.

SUMMARY OF THE INVENTION

In Japanese Patent Application Publication No. 2000-177855, in the case where a foreign object is present on an installation surface for an image forming apparatus and the sheet stacking portion runs on the foreign object in the vicinity of the rack, the position of the rack becomes higher than expected. As a result, when no sheet is present, the rack, the idler gear, and the gear of the feeding roller are not engaged with each other properly, the sheet stacking portion is not discharged even when no sheet is present, and there is a possibility that the presence or absence of the sheet may not be detected. In addition, while the sheet stacking portion is often manufactured by injection molding, in a component manufactured by injection molding, a warp occurs due to heat shrinkage of a molding material and molding conditions. Also in the case where deformation such as a warp caused by injection molding is present in the sheet stacking portion, when no sheet is present, the rack, the idler gear, and the gear of the feeding roller are not engaged with each other properly, and there is a possibility that the presence or absence of the sheet may not be detected.

In Japanese Patent Application Publication No. 2006-182463, the sheet stacking portion is detachable, space in which the sheet stacking portion is mounted is provided in the image forming apparatus, and the lever for performing sheet detection is provided at a bottom portion of the space. Consequently, the lever can operate even when the sheet stacking portion is detached from the image forming apparatus. Accordingly, even in the case where the sheet is placed directly in the space, it follows that the presence of the sheet is detected and, when a sheet feeding command is issued, a sheet feeding operation is executed. The sheet subjected to the sheet feeding operation in a state in which the sheet stacking portion is detached is not conveyed properly, and there is a possibility that feed failures such as double feed and non-feed, and jamming may occur.

An object of the present invention is to detect the presence or absence of sheets stacked in a sheet stacking portion with high accuracy.

A sheet feeding apparatus according to the present invention includes a sheet stacking portion having a stacking surface on which a sheet is stacked; a feeding unit configured to come into contact with the sheet placed in the sheet stacking portion and to feed the sheet to a conveyance path; and a detection unit provided to be movable with respect to the sheet stacking portion and configured to detect the sheet by causing a contact portion to come into contact with an uppermost sheet stacked on the stacking surface, wherein a bottom portion of the sheet stacking portion forms a part of a bottom portion of the sheet feeding apparatus, the sheet stacking portion is provided with a through hole configured to be exposed in a case where no sheet is stacked on the stacking surface, the through hole penetrating the stacking surface to a bottom surface of the sheet stacking portion, and the contact portion is positioned inside the through hole in the case where no sheet is stacked on the stacking surface.

According to the present invention, it is possible to detect the presence or absence of the sheets stacked in the sheet stacking portion with high accuracy.

Further features of the present invention will become apparent from the following description of exemplary embodiments with reference to the attached drawings.

DESCRIPTION OF THE EMBODIMENTS

An embodiment of the present invention will be described. Herein, the embodiment in which the present invention is applied to an inkjet recording apparatus will be described, but the present invention is not limited to the inkjet recording apparatus.

Figure 1:
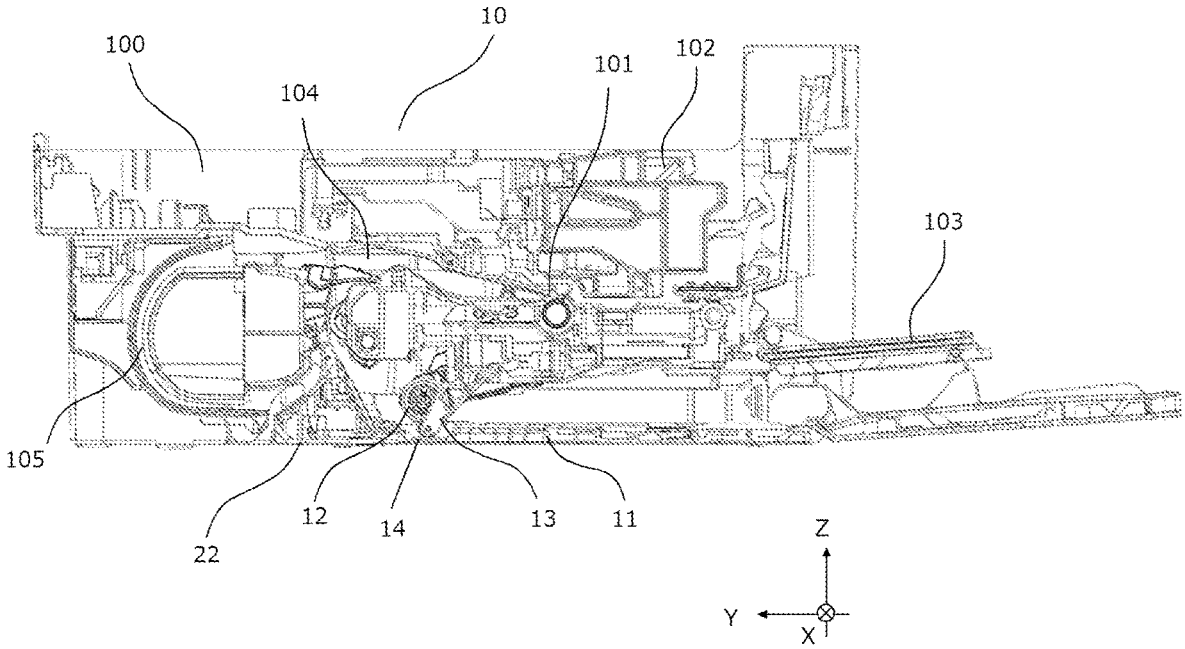
FIG. 1 is a schematic cross-sectional view of a sheet feeding apparatus of an embodiment.
Figure 2A:
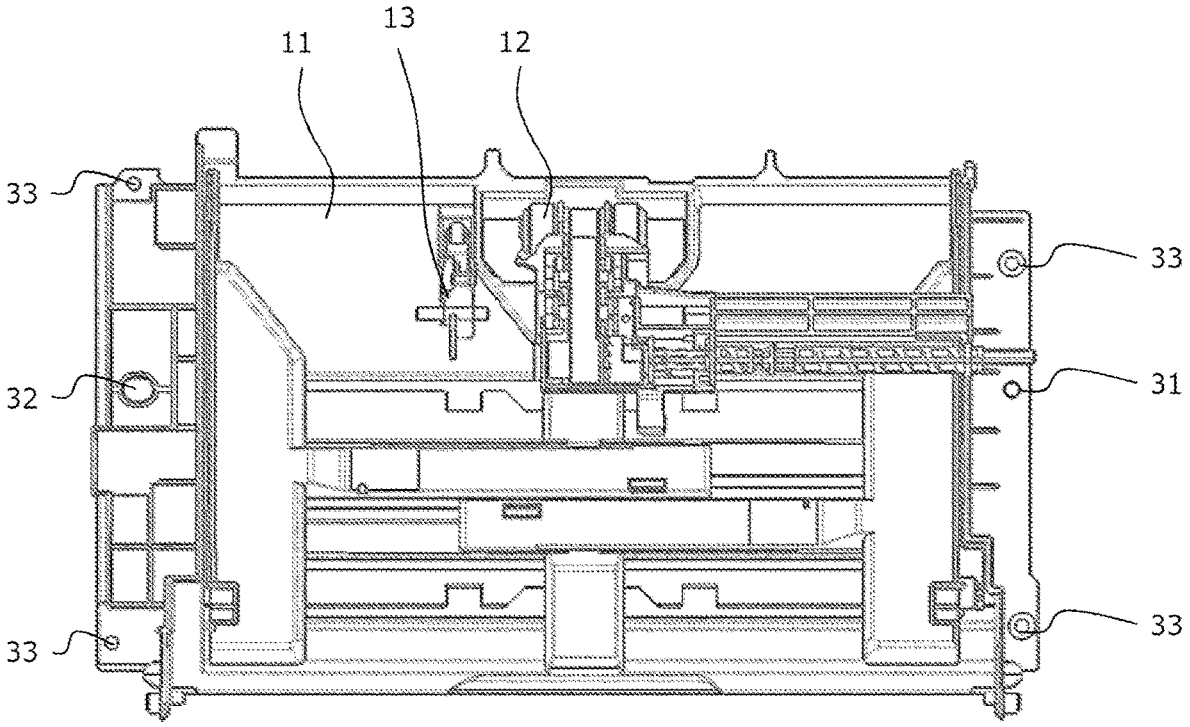
FIGS. 2A and 2B are plan views showing positions of a sheet stacking portion and a detection lever of the embodiment.
Figure 2B:
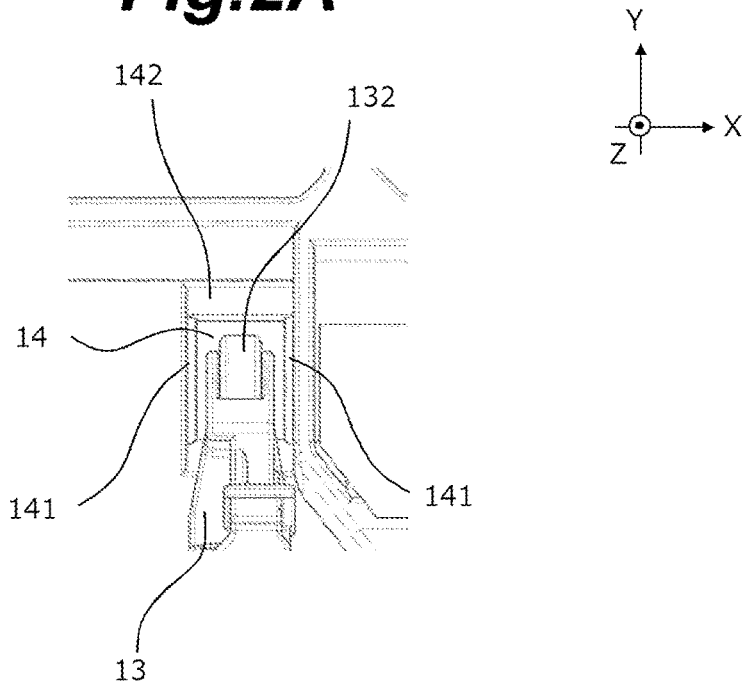

FIG. 1 is a view showing a schematic cross-sectional view of a recording apparatus including a sheet feeding apparatus of the embodiment. FIG. 2A is a view in which a sheet stacking portion 11 is viewed from an upper surface, and FIG. 2B is a view in which the vicinity of a detection lever 13 and a through hole 14 in FIG. 2A is enlarged and shown. FIGS. 3A, 3B, 3C, and 3D are views each showing a state in which a sheet feeding apparatus 10 detects the presence or absence of a sheet with the detection lever 13. Hereinbelow, Y direction represents a conveyance direction of the sheet by the sheet feeding apparatus 10, Z direction represents an upward vertical direction, and X direction represents a direction perpendicular to the conveyance direction and the vertical direction. The X direction also represents a width direction of the sheet and a movement direction of a recording head. Note that the recording apparatus can record an image not only on paper as the sheet but also on a sheet-shaped recording material.

The recording apparatus has the sheet feeding apparatus 10 which feeds the sheet to a recording head 102 which forms an image on the sheet with an inkjet system. The sheet feeding apparatus 10 has a case 100, and the sheet stacking portion 11 which is provided so as to form part of a bottom portion of the sheet feeding apparatus 10. Sheets stacked on a stacking surface of the sheet stacking portion 11 are fed to a first conveyance path 104 by a feeding roller 12. The feeding roller 12 comes into contact with the sheets stacked in the sheet stacking portion 11 and feeds the sheets to the first conveyance path 104. Each sheet fed to the first conveyance path 104 is conveyed to the recording head 102 by a conveyance roller 101. The recording head 102 records an image based on image data on the sheet. The sheet feeding apparatus 10 has a second conveyance path 105 for reversing an image recording target surface of the sheet in the case where images are to be recorded on both surfaces of the sheet. The conveyance roller 101 conveys the sheet in which image recording on the front surface is completed to the second conveyance path 105, and the sheet conveyed to the second conveyance path 105 is conveyed to the recording head 102 through the first conveyance path 104 again, and image recording on the back surface is performed.

The sheet feeding apparatus 10 has a separation slope 16 for separating the sheets fed by the feeding roller 12, and the detection lever 13 for coming into contact with the sheet placed in the sheet stacking portion 11 to detect the presence or absence of the sheet. The feeding roller 12 is provided at a tip of an arm which is rotatable about a rotation shaft 121 provided in the case 100 of the sheet feeding apparatus 10, and feeds the sheets placed in the sheet stacking portion 11 one by one into a recording apparatus main body. The detection lever 13 is provided to be movable relative to the sheet stacking portion 11 of the sheet feeding apparatus 10, and has a roller 132 which serves as a contact portion which is configured to come into contact with the uppermost sheet of the stacked sheets in the case where the sheets are stacked on a stacking surface 21. In the present embodiment, the detection lever 13 is provided to be rotatable about a rotation shaft 131 provided in the case 100 of the sheet feeding apparatus 10, and the roller 132 is provided at a tip of the detection lever 13 to face the sheet stacking portion 11. While the sheet is fed into the recording apparatus main body by the feeding roller 12, the detection lever 13 comes into contact with the sheet via the roller 132, and hence an increase in the conveyance resistance of the sheet caused by the contact of the detection lever 13 with the sheet is suppressed. The presence or absence of the sheet placed in the sheet stacking portion 11 is detected by the detection lever 13.

The sheet stacking portion 11 is fixed to the sheet feeding apparatus 10. Note that the present invention can also be applied to the sheet feeding apparatus having a detachable sheet stacking portion. In the stacking surface 21 of the sheet stacking portion 11, the through hole 14 which is configured to be exposed in the case where no sheet is stacked on the stacking surface 21, the through hole 14 penetrating the stacking surface 21 to a bottom surface of the sheet stacking portion 11 is provided. The roller 132 of the detection lever 13 is provided so as to be positioned inside the through hole 14 in the case where no sheet is stacked on the stacking surface 21. The through hole 14 is provided at a location to which the roller 132 at the tip of the detection lever 13 is close. The roller 132 of the detection lever 13 is provided at a position which is offset in the width direction of the sheet (X direction) with respect to the feeding roller 12. Specifically, the detection lever 13 is provided at a position about 40 mm away in a −X direction from the feeding roller 12 positioned at a central portion of the sheet stacking portion 11 in the X direction. This allows the detection lever 13 to operate without interfering with the feeding roller 12. With regard to a relationship among sizes of the detection lever 13, the roller 132, and the through hole 14 in the X direction, if it is assumed that the size of the roller 132 in the X direction is 1, the size of the detection lever 13 in the X direction is 1.6, and the size of the through hole 14 in the X direction is 2.1. Herein, the size of the through hole 14 in the X direction corresponds to a size between tips of ribs 141 provided at both ends of the through hole 14 in the X direction. The size (height) of the rib 141 in the Z direction is configured to narrow an opening portion of the through hole 14 by setting the size of the rib 141 to a size which does not allow the detection lever 13 and the rib 141 to interfere with each other in a state in which the detection lever 13 is at a position at which the detection lever 13 detects the absence of the sheet. Note that an offset amount of the roller 132 with respect to the feeding roller 12 and the sizes of the roller 132, the detection lever 13, and the through hole 14 are only examples, and are not limited to the offset amount thereof and the sizes thereof mentioned above.

Figure 3A:
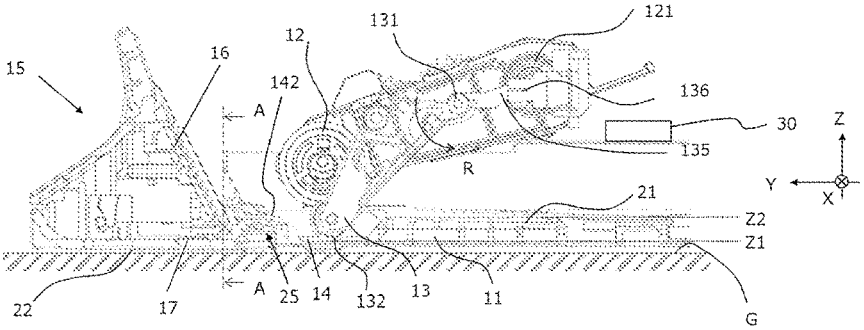
FIGS. 3A, 3B, 3C, and 3D are cross-sectional views each showing an operation of the detection lever of the embodiment.
Figure 3B:
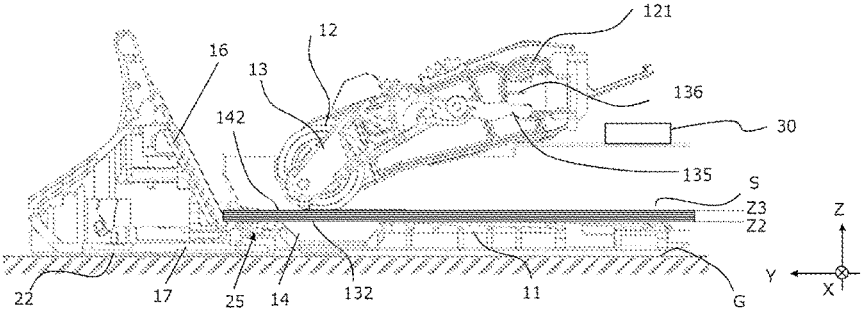
Figure 3C:
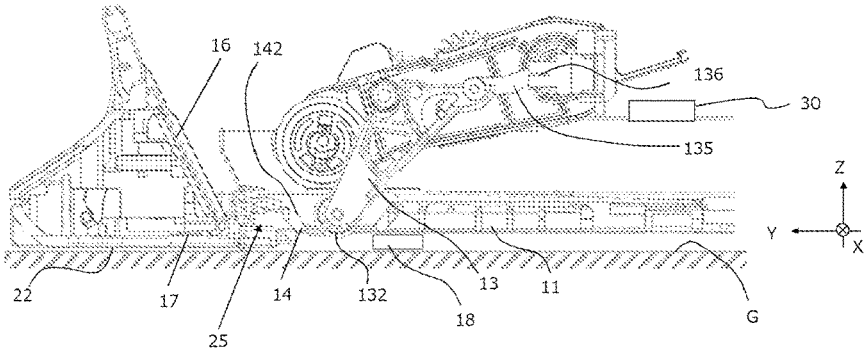
Figure 3D:
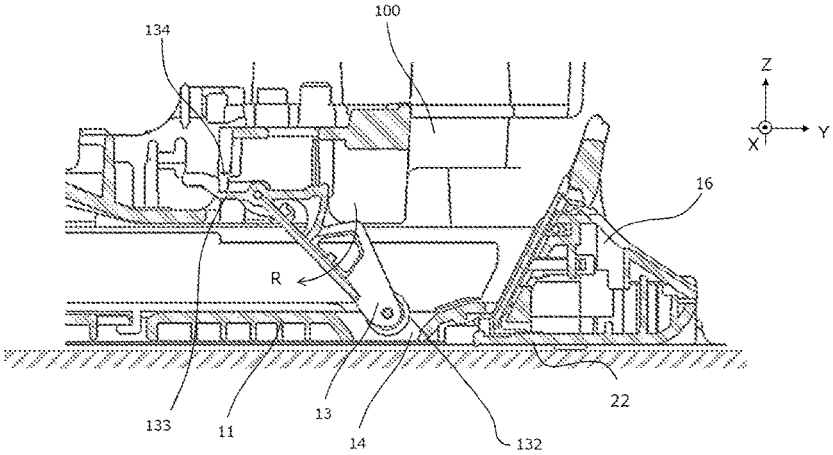

As shown in FIGS. 3A and 3D, when the sheet is not present on the stacking surface 21 of the sheet stacking portion 11, the through hole 14 provided in the stacking surface 21 is exposed, and a tip portion of the detection lever 13 falls into the through hole 14. At this point, the position of the lowest point of the roller 132 (hereinafter also referred to as the tip portion of the detection lever 13) in the Z direction is lower than the position of the stacking surface 21 of the sheet stacking portion 11 in the Z direction. This state corresponds to a state in which the detection lever 13 is at a sheet absence detection position.

The detection lever 13 is provided to be rotatable about the rotation shaft 131. The detection lever 13 rotates in an arrow R direction by its own weight in a state in which an external force does not act, and the position of the roller 132 in the Z direction is lowered. The sheet feeding apparatus 10 has a regulation unit for regulating a range of movement of the detection lever 13 such that the roller 132 does not move to a position below a predetermined position inside the through hole 14 in the case where no sheet is stacked on the stacking surface 21 of the sheet stacking portion 11. Specifically, a posture holding portion 133 is provided in the detection lever 13, and a posture holding portion 134 is provided in the case 100. When the detection lever 13 rotates in the R direction and the position of the roller 132 in the Z direction is lowered to a predetermined position, the posture holding portion 133 and the posture holding portion 134 come into contact with each other, and further rotation of the detection lever 13 in the R direction is regulated. When the posture holding portion 133 and the posture holding portion 134 come into contact with each other, the tip portion of the detection lever 13 is at the reachable lowest point. A position Z1 in the Z direction when the tip portion of the detection lever 13 is at the lowest point is lower than a position Z2 of the stacking surface 21 of the sheet stacking portion 11 in the Z direction. A state in which the tip portion of the detection lever 13 is at the position Z1 of the lowest point corresponds to a state in which the detection lever 13 is at the sheet absence detection position. Note that the lowest point which the tip portion of the detection lever 13 can reach is at a position higher than an installation surface for the sheet feeding apparatus 10.

As shown in FIG. 3B, in the case where sheets S are stacked in the sheet stacking portion 11, the roller 132 of the detection lever 13 comes into contact with an upper surface of the uppermost sheet of the stacked sheets, and is supported by a reaction force received from the sheet. This prevents the roller 132 of the detection lever 13 from falling into the through hole 14. At this point, the position of the tip portion of the detection lever 13 is a position Z3 of the upper surface of the uppermost sheet of the stacked sheets. In the case where the sheets S are stacked in the sheet stacking portion 11, the position Z3 of the tip portion of the detection lever 13 in the Z direction is higher than the position Z2 of the stacking surface 21 of the sheet stacking portion 11 in the Z direction. A state in which the position of the tip portion of the detection lever 13 in the Z direction is higher than Z2 corresponds to a state in which the detection lever 13 is at a sheet presence detection position.

The sheet feeding apparatus 10 has a sensor 136 constituted by an optical sensor. The sensor 136 outputs a signal corresponding to light incident from the outside to a control portion 30. The detection lever 13 has a light-shielding portion 135 which is an opening-closing unit configured to open and close an optical path to the sensor 136 on a side opposite to the side of the roller 132 with the rotation shaft 131 interposed between the light-shielding portion 135 and the roller 132. The light-shielding portion 135 switches between opening and closing of the optical path according to whether the roller 132 is at the predetermined position inside the through hole or at a position higher than the stacking surface 21 of the sheet stacking portion 11. In the present embodiment, the light-shielding portion 135 blocks the optical path to the sensor 136 when the detection lever 13 is at the sheet absence detection position, and opens the optical path to the sensor 136 when the detection lever 13 is at the sheet presence detection position. When the control portion 30 receives a signal indicating that light is detected from the sensor 136, the control portion 30 determines that the sheets stacked in the sheet stacking portion 11 are present. When the control portion 30 receives a signal indicating that light is not incident from the sensor 136, the control portion 30 determines that the sheets stacked in the sheet stacking portion 11 are absent.

Note that, according to the presence or absence of the sheet in the sheet stacking portion 11, the position of the tip portion of the detection lever 13 in the Z direction changes, and an angle of rotation of the detection lever 13 changes. Consequently, in addition to the method which detects the presence or absence of the sheet based on opening and closing of the optical path of the sensor 136 caused by the rotation of the detection lever 13, the position of the tip portion of the detection lever 13 in the Z direction or the angle of rotation of the detection lever 13 may be measured, and the presence or absence of the sheet may be detected based on the measurement.

In the case where the sheets are stacked on the stacking surface 21 of the sheet stacking portion 11, a position at which the feeding roller 12 comes into contact with the sheet is on an upstream side in the conveyance direction of the sheet of a position at which the roller 132 of the detection lever 13 comes into contact with the sheet. Specifically, as shown in FIG. 3B, when the detection lever 13 is at the sheet presence detection position, the position of the rotation center of the feeding roller 12 in the Y direction is on the upstream side in the conveyance direction (−Y direction) of the position of the rotation center of the roller 132 of the detection lever 13 in the Y direction. With this, even when a sheet feeding operation is executed in a state in which a tip of the sheet on a downstream side in the conveyance direction is stopped at the position of the roller 132, the tip of the sheet on the downstream side in the conveyance direction reliably reaches the feeding roller 12, and hence the sheet feeding operation is performed properly. Conversely, if it is assumed that the rotation center of the roller 132 is on the upstream side in the conveyance direction (−Y direction) of the rotation center of the feeding roller 12 when the detection lever 13 is at the sheet presence detection position, when the tip of the sheet is stopped at the position of the roller 132, the tip of the sheet does not reach the feeding roller 12. Consequently, when the sheet feeding operation is executed in this state, the sheet feeding operation is not performed properly. In the configuration of the present embodiment, it is possible to suppress an influence on the sheet feeding operation caused by the contact of the roller 132 of the detection lever 13 with the sheet.

FIG. 3C is a view showing a state in which a foreign object 18 is present on an installation surface G of the sheet feeding apparatus 10 and the sheet feeding apparatus 10 is installed on the foreign object 18. Even when the sheet feeding apparatus 10 is installed on the foreign object 18, in the case where the size of the foreign object 18 is sufficiently small as compared with the size of the sheet feeding apparatus 10, there are cases where the sheet feeding apparatus 10 does not seem to be lifted, and the sheet feeding apparatus 10 looks as if the sheet feeding apparatus 10 were normally installed. In these cases, the user cannot notice that the sheet feeding apparatus 10 rests on the foreign object 18. However, even when the foreign object 18 is small, in the case where a bottom portion of the sheet stacking portion 11 of the sheet feeding apparatus 10 rests on the foreign object 18, the sheet stacking portion 11 is brought into a state in which the sheet stacking portion 11 is lifted from a normal position by a height corresponding to the foreign object 18.

An inner wall surface of the through hole 14 is configured to have a shape which does not allow the inner wall surface to interfere with the roller 132 in the range of movement of the roller 132 of the detection lever 13 irrespective of the position of the bottom surface of the sheet stacking portion 11 in a direction perpendicular to the installation surface for the sheet feeding apparatus 10. In the present embodiment, as shown in FIG. 2B and FIGS. 3A to 3D, an end portion of the through hole 14 of the sheet stacking portion 11 on the downstream side in the conveyance direction (+Y direction) is connected to the stacking surface 21 of the sheet stacking portion 11 via a slope 142. The slope 142 is formed to be substantially parallel to an outer peripheral surface of the roller 132 and reach the height of the stacking surface 21 of the sheet stacking portion 11 gradually toward the downstream side in the conveyance direction. Consequently, as shown in FIG. 3C, even when the sheet stacking portion 11 is lifted by the height corresponding to the foreign object 18, the roller 132 can rotate without interfering with the sheet stacking portion 11. Accordingly, in the case where the sheet is not present on the stacking surface 21 of the sheet stacking portion 11, similarly to FIG. 3A in which the sheet stacking portion 11 is not lifted by the foreign object 18, the tip portion of the detection lever 13 falls into the through hole 14 without interfering with the sheet stacking portion 11. In addition, the detection lever 13 can rotate in the arrow R direction until the posture holding portion 133 and the posture holding portion 134 provided in the case 100 come into contact with each other without being obstructed by the lifted sheet stacking portion 11. At this point, similarly to the case of FIG. 3A in which the sheet stacking portion 11 is not lifted by the foreign object 18, the roller 132 at the tip portion of the detection lever 13 is in the through hole 14. With this, the detection lever 13 can reach the sheet absence detection position, and hence the optical path of the sensor 136 is blocked by the light-shielding portion 135, and the control portion 30 can detect the absence of the sheet. Thus, according to the sheet feeding apparatus 10 of the present embodiment, also in a state in which the bottom surface of the sheet stacking portion 11 rests on the foreign object 18 and the sheet stacking portion 11 is thereby lifted, in the case where there is no sheet stacked in the sheet stacking portion 11, the presence of the sheet is not erroneously detected.

Figure 4A:
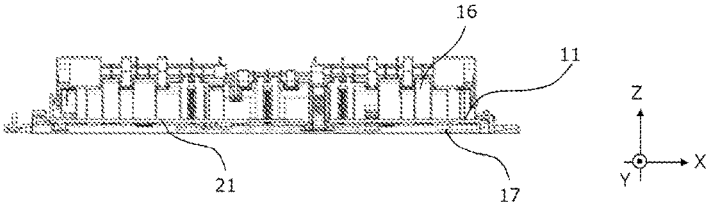
FIGS. 4A, 4B, 4C, 4D, 4E, and 4F are schematic views each showing a warp of a component of the embodiment.
Figure 4B:
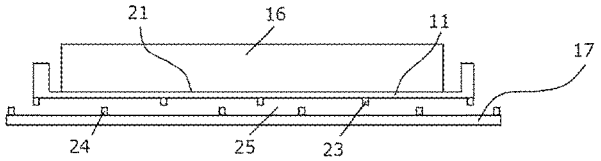
Figure 4C:
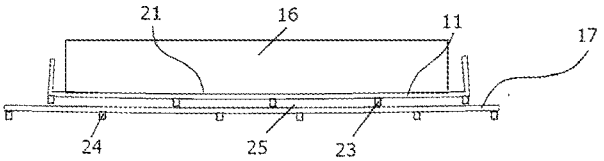
Figure 4D:
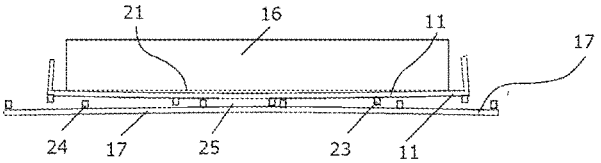
Figure 4E:
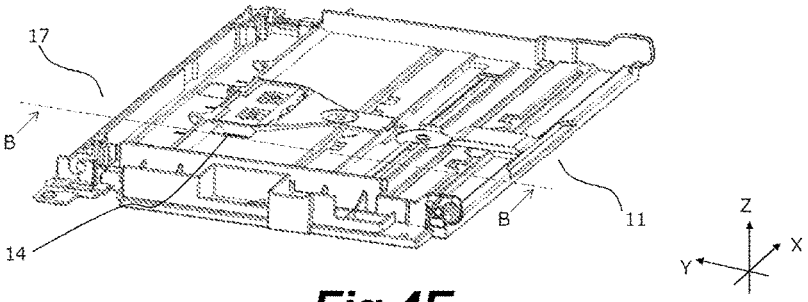
Figure 4F:
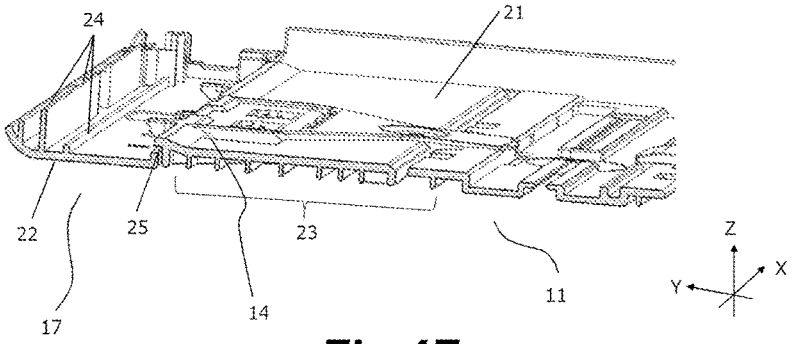

By using FIGS. 4A, 4B, 4C, 4D, 4E, and 4F, a description will be given of an influence by a warp of a component manufactured by injection molding in the sheet feeding apparatus 10. FIG. 4A is a view showing a cross section along the line A-A of FIG. 3A. FIG. 4B is a view schematically showing a portion of a joint portion 25 in which the sheet stacking portion 11 and a separation slope base 17 in FIG. 4A are stacked on each other. Each of FIGS. 4C and 4D is a conceptual view in which warps of components in FIG. 4B which are caused by injection molding are exaggerated. FIG. 4E is a view showing structures of the sheet stacking portion 11 and the separation slope base 17. FIG. 4F is a view showing a cross section along the line B-B of FIG. 4E.

As shown in FIG. 3A, the sheet feeding apparatus 10 has the sheet stacking portion 11 and a separation portion 15. The separation portion 15 separates sheets conveyed from the sheet stacking portion 11 by the feeding roller 12. The separation portion 15 has the separation slope 16, and the separation slope base 17 which supports the separation slope 16. The sheet stacking portion 11 and the separation portion 15 are separate components which are independent of each other and, in the joint portion 25 of the separation portion 15 and the sheet stacking portion 11, an end portion of the separation portion 15 and an end portion of the sheet stacking portion 11 are disposed to be stacked on each other vertically. In the present embodiment, the sheet stacking portion 11 and the separation portion 15 are combined in the joint portion 25 in the vicinity of the slope 142 leading to the through hole 14 of the sheet stacking portion 11 to constitute the sheet feeding apparatus 10. As shown in FIG. 3A and FIG. 4A, the end portion of the sheet stacking portion 11 in the +Y direction and the end portion of the separation portion 15 in the −Y direction are combined with each other in the joint portion 25 such that the sheet stacking portion 11 is placed on an upper surface of the separation slope base 17. Note that a configuration may also be adopted in which the sheet stacking portion 11 is placed on a lower surface of the separation slope base 17.

A component which is one of the separation portion 15 and the sheet stacking portion 11 and is disposed on an upper side in the joint portion 25 has a shape in which a warp caused by molding is protruded downward, and a component which is one of the separation portion 15 and the sheet stacking portion 11 and is disposed on a lower side in the joint portion 25 has a shape in which a warp caused by molding is protruded upward. For example, the component which is disposed on the upper side in the joint portion 25 has a shape in which a rib projects downward from a plane, and the component which is disposed on the lower side in the joint portion 25 has a shape in which a rib projects upward from a plane. In the present embodiment, as shown in FIG. 4F, ribs 23 are provided on a lower surface of the stacking surface 21 of the sheet stacking portion 11 so as to project downward in the Z direction, and the lower surface thereof has a downward U-shape which is opened downward in the Z direction in a cross section perpendicular to the X direction. On the other hand, ribs 24 are provided on an upper surface (a surface on the back of a bottom surface 22) of the separation slope base 17 so as to project upward in the Z direction, and the upper surface thereof has an upward U-shape which is opened upward in the Z direction in a cross section perpendicular to the X direction.

Herein, each of the sheet stacking portion 11 and the separation slope base 17 is a component manufactured by injection molding. In the injection molding, molding is performed by pouring a plastic material into a mold including a cavity (female mold) and a core (male mold). During the molding, a warp occurs in a molded component due to a mold shape and a molding condition. In a molded component having a shape in which a rib projects from a plane such as, e.g., the sheet stacking portion 11 or the separation slope base 17 in FIG. 4F, there are cases where a warp occurs such that a surface from which the rib projects is protruded. In FIG. 4F, in the sheet stacking portion 11, the ribs 23 project from the lower surface, and hence a warp having a downward protruded shape occurs. On the other hand, in the separation slope base 17, the ribs 24 project from the upper surface, and hence a warp having an upward protruded shape occurs. In the joint portion 25 in which the sheet stacking portion 11 is positioned on the upper side and the separation slope base 17 is positioned on the lower side, as shown in FIG. 4D, the sheet stacking portion 11 and the separation slope base 17 are stacked on each other such that directions of the warps are opposite to each other and surfaces which are warped so as to have the protruded shapes face each other. Thus, in the present embodiment, the two components are stacked on each other such that the direction of the warp caused by molding which occurs in one of the components and the direction of the warp caused by molding which occurs in the other component are opposite to each other, and the surfaces which are warped so as to have the protruded shapes face each other. With this, in the case where a large warp caused by molding occurs, the protruded surfaces of the two components which face each other come into contact with each other in the joint portion in which the two components are stacked on each other, and hence influences by the warps can be canceled out.

On the other hand, as shown in FIG. 4C, in the case where the sheet stacking portion 11 and the separation slope base 17 are stacked on each other such that the directions of the warps having downward protruded shapes become identical to each other, in the joint portion 25, the positions of the separation slope base 17 and the sheet stacking portion 11 become lower than those in the case where there is no warp. The position of the stacking surface 21 also becomes lower than that in the case where there is no warp. Consequently, even in the case where the sheet is present on the stacking surface 21, the detection lever 13 reaches the sheet absence detection position, and may erroneously detect the absence of the sheet.

In the present embodiment, as shown in FIG. 4D, the sheet stacking portion 11 and the separation slope base 17 are stacked on each other in the joint portion 25 such that the influences caused by the warps of the sheet stacking portion 11 and the separation slope base 17 are cancelled out, and hence it is possible to prevent erroneous detection of the presence or absence of the sheet.

Figure 5A:
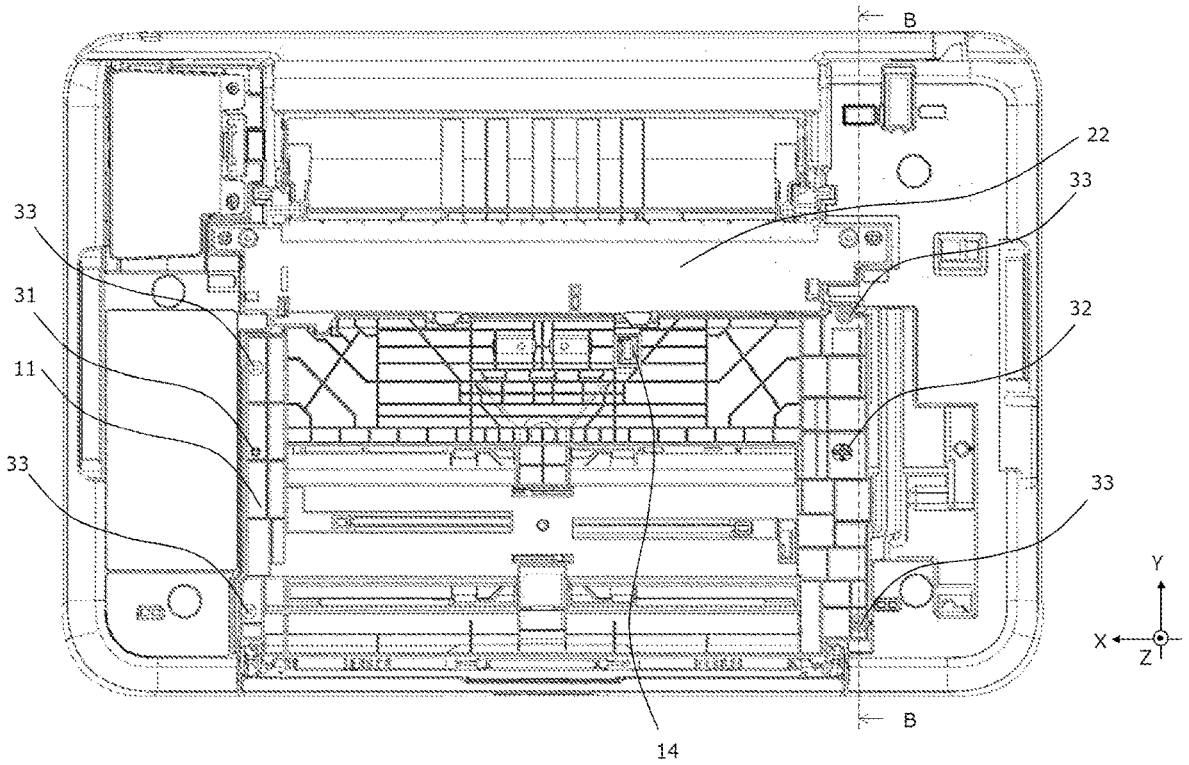
FIGS. 5A, 5B, and 5C are bottom views each showing a fastening portion of the embodiment.
Figure 5B:
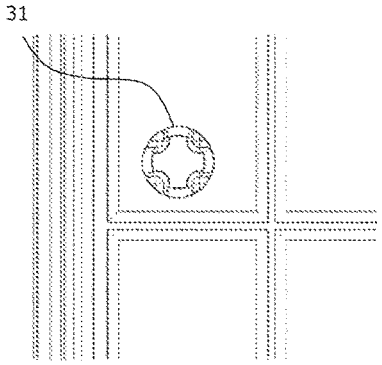
Figure 5C:
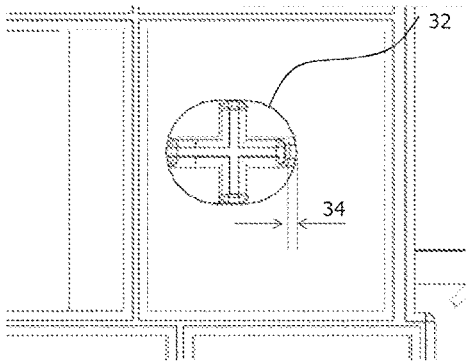

FIG. 5A is a view in which the sheet feeding apparatus 10 is viewed from a bottom surface side. FIGS. 5B and 5C are views in which a fitting hole portion 31 and an elongated hole portion 32 are enlarged and shown. The sheet stacking portion 11 is positioned in the X direction by the fitting hole portion 31 and is positioned in the Y direction by the fitting hole portion 31 and the elongated hole portion 32, and the sheet stacking portion 11 is fastened to the sheet feeding apparatus 10 by fastening portions 33 so as not to be detached by an operation of a user.

Figure 6A:
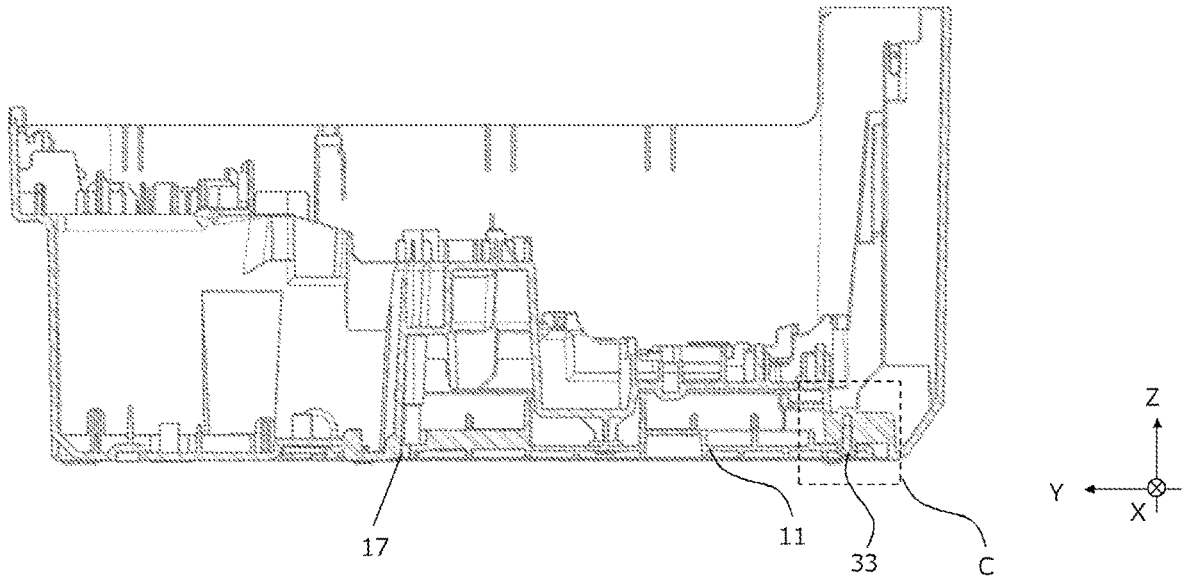
FIGS. 6A and 6B are cross-sectional views each showing the fastening portion of the embodiment.
Figure 6B:
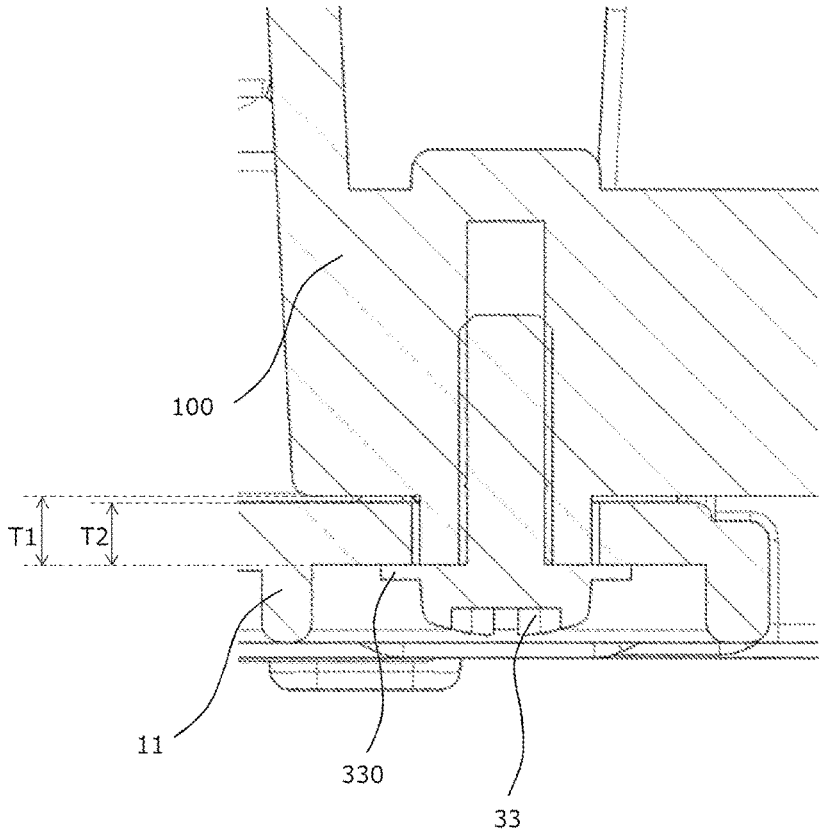

FIG. 6A shows a cross section along the line B-B of FIGS. 5A, and 6B shows the details of a surrounding portion C of the fastening portion 33 in FIG. 6A. Fastening by the fastening portion 33 is performed in a mode in which the sheet stacking portion 11 is held between the case 100 of the sheet feeding apparatus 10 and a flange portion 330 of the fastening portion 33. When it is assumed that a distance in the Z direction between a bottom surface of the case 100 of the sheet feeding apparatus 10 and an upper surface of the flange portion 330 of the fastening portion 33 is T1, and a thickness of a portion held between the flange portion 330 of the fastening portion 33 of the sheet stacking portion 11 and the case 100 in the Z direction is T2, T1>T2 is satisfied. Consequently, while the sheet stacking portion 11 is fixed in the X direction and the Y direction with respect to the case 100 in the fastening portion 33, the sheet stacking portion 11 is not completely fixed in the Z direction, the sheet stacking portion 11 has a backlash having a gap corresponding to a difference between T1 and T2, and the sheet stacking portion 11 can move freely within the range of the backlash. With this backlash, when a shock is applied to the sheet stacking portion 11 in the Z direction due to, e.g., a fall during conveyance or the like, the sheet stacking portion 11 is significantly deformed in the Z direction. A backlash 34 of the elongated hole portion 32 provided in the sheet stacking portion 11 is pulled by the deformation to be moved in a direction (X direction) in which the backlash 34 is reduced. However, the sheet stacking portion 11 is configured to be able to move freely within the range of the backlash provided in the fastening portion 33 when the sheet stacking portion 11 is freed from a force caused by the shock, and hence the sheet stacking portion 11 does not hold a deformed posture and can return to a posture before the shock is applied. Thus, it is possible to prevent the deformation of the sheet stacking portion 11, and hence it is possible to prevent the occurrence of erroneous detection in sheet detection by the detection lever 13 caused by interference between the detection lever 13 and the sheet stacking portion 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-118866, filed on Jul. 19, 2021, which is hereby incorporated by reference herein in its entirety.

What is claimed is:

1. A sheet feeding apparatus comprising:

a housing having a first bottom surface of the sheet feeding apparatus;

a sheet stacking portion, fastened to the housing, having a stacking surface on which one or more sheets are stacked and a second bottom surface of the sheet feeding apparatus and provided with a through-hole penetrating the stacking surface to the second bottom surface of the sheet feeding apparatus, the first and second bottom surfaces both being disposed on an exterior of the sheet feeding apparatus;

a feeding unit configured to come into contact with an uppermost sheet of the one or more sheets placed in the sheet stacking portion and to feed the uppermost sheet to a conveyance path;

a detection unit including a sensor and a lever which rotates about a rotation shaft provided in the housing and configured to detect the one or more sheets by causing a contact portion of the lever to come into contact with the uppermost sheet stacked on the stacking surface, the lever interacting with the sensor to detect presence and absence of the uppermost sheet; and a stop provided in the housing and configured to regulate a movement of the contact portion such that the contact portion does not move below a predetermined position disposed between the stacking surface and an installation surface for the sheet feeding apparatus due to a part of the lever coming into contact with the stop in a case in which no sheets are stacked on the stacking surface.

2. The sheet feeding apparatus according to claim 1, wherein the detection unit has an optical sensor and an opening-closing unit configured to open and close an optical path to the optical sensor, and the opening-closing unit is configured to switch between opening and closing of the optical path according to whether the contact portion is at a predetermined position inside the through-hole or at a position higher than the stacking surface of the sheet stacking portion.

3. The sheet feeding apparatus according to claim 1, wherein, in a case where the one or more sheets is stacked on the stacking surface of the sheet stacking portion, a position at which the feeding unit comes into contact with the uppermost sheet is further upstream with respect to a conveyance direction of the one or more sheets than a position at which the contact portion of the detection unit comes into contact with the uppermost sheet.

4. The sheet feeding apparatus according to claim 1, wherein an inner wall surface of the through-hole is configured to have a shape which does not allow the inner wall surface to interfere with the contact portion in a range of movement of the contact portion of the detection unit, irrespective of a position of the bottom surface of the sheet feeding apparatus in a direction perpendicular to the installation surface for the sheet feeding apparatus.

5. The sheet feeding apparatus according to claim 1, wherein the contact portion of the detection unit is provided at a position which is offset in a width direction of the one or more sheets with respect to the feeding unit.

6. The sheet feeding apparatus according to claim 1, further comprising a separation portion configured to separate the uppermost sheet conveyed from the sheet stacking portion by the feeding unit, wherein the separation portion and the sheet stacking portion are constituted by different components and an end portion of the separation portion and an end portion of the sheet stacking portion are disposed to be stacked on each other vertically in a joint portion of the separation portion and the sheet stacking portion, the component from among the separation portion and the sheet stacking portion that is disposed on an upper side in the joint portion has a shape in which a warp caused by molding is protruded downward, and the component from among the separation portion and the sheet stacking portion that is disposed on a lower side in the joint portion has a shape in which a warp caused by molding is protruded upward.

7. The sheet feeding apparatus according to claim 6, wherein the component from among the separation portion and the sheet stacking portion that is disposed on the upper side in the joint portion has a shape in which a rib projects downward from a plane, and the component from among the separation portion and the sheet stacking portion that is disposed on the lower side in the joint portion has a shape in which a rib projects upward from a plane.

8. The sheet feeding apparatus according to claim 6, wherein the component disposed on the upper side in the joint portion is the sheet stacking portion, and the component disposed on the lower side in the joint portion is the separation portion.

9. The sheet feeding apparatus according to claim 1, wherein the sheet stacking portion is fixed to the housing by a fastening portion, and a gap is present between the sheet stacking portion and the housing in the fastening portion.

10. The sheet feeding apparatus according to claim 1, wherein the contact portion comprises a roller.

11. The sheet feeding apparatus according to claim 1, wherein the feeding unit comprises an arm and a feeding roller provided at a tip of the arm.

12. The sheet feeding apparatus according to claim 1, further comprising a recording head configured to record an image on the one or more sheets fed by the feeding unit.

13. The sheet feeding apparatus according to claim 1, wherein in case that the sheet feeding apparatus is installed on a foreign object, the sheet stacking portion is lifted with respect to the housing by the foreign object.

* * * * *